US007267134B2

(12) United States Patent
Hochstein, Jr. et al.

(10) Patent No.: US 7,267,134 B2
(45) Date of Patent: Sep. 11, 2007

(54) CONTROL OF DETONATIVE CLEANING APPARATUS

(75) Inventors: James R. Hochstein, Jr., Seattle, WA (US); Michael J. Aarnio, Kirkland, WA (US); Donald W. Kendrick, Bellevue, WA (US); Thomas R. A. Bussing, Sammamish, WA (US); Robert R. Niblock, Kent, WA (US)

(73) Assignee: United Technologies Corporation, Hartford, CT (US)

( * ) Notice: Subject to any disclaimer, the term of this patent is extended or adjusted under 35 U.S.C. 154(b) by 506 days.

(21) Appl. No.: 10/801,215

(22) Filed: Mar. 15, 2004

(65) Prior Publication Data

US 2005/0199743 A1 Sep. 15, 2005

(51) Int. Cl.
*B08B 3/12* (2006.01)

(52) U.S. Cl. ..... 134/166 R; 134/166 C; 134/184; 134/186; 122/379

(58) Field of Classification Search ..... 134/184, 134/186, 166 R, 166 C; 122/379, 395, 390
See application file for complete search history.

(56) References Cited

U.S. PATENT DOCUMENTS

| | | | | |
|---|---|---|---|---|
| 5,082,502 | A | 1/1992 | Lee et al. | |
| 5,430,691 | A | 7/1995 | Fridman | |
| 5,494,004 | A | 2/1996 | Hunter, Jr. | |
| 5,676,712 | A * | 10/1997 | Anderson | 48/192 |
| 6,438,191 | B1 | 8/2002 | Bickes, Jr. et al. | |
| 6,684,823 | B1 | 2/2004 | Plavnik et al. | |
| 2002/0112638 | A1 | 8/2002 | Zilka et al. | |
| 2004/0112306 | A1 | 6/2004 | Ruegg | |

FOREIGN PATENT DOCUMENTS

| | | |
|---|---|---|
| CN | 2324423 | 6/1999 |
| CN | 2426572 | 4/2001 |

(Continued)

OTHER PUBLICATIONS

English language translation of the first Official action of the Russian Patent Office in Russian Patent Application 2004-133923.

(Continued)

*Primary Examiner*—Michael Barr
*Assistant Examiner*—Saeed Chaudhry
(74) *Attorney, Agent, or Firm*—Bachman & LaPointe, P.C.

(57) ABSTRACT

A shockwave cleaning apparatus cleans one or more surfaces within a vessel. A sensor senses one or more thermodynamic properties associated with the vessel. A control system is coupled to an initiator and a fuel/oxidizer source to control the firing of the apparatus responsive to input from the sensor.

21 Claims, 7 Drawing Sheets

FOREIGN PATENT DOCUMENTS

| | | | | |
|---|---|---|---|---|
| RU | 2054151 | | * | 2/1996 |
| RU | 2054151 | C1 | | 2/1996 |
| RU | 2094728 | | * | 10/1997 |
| RU | 2094728 | C1 | | 10/1997 |
| SU | 328318 | | | 2/1972 |
| SU | 328318 | | * | 7/1991 |
| SU | 1661721 | A1 | | 7/1991 |
| WO | WO 01/78912 | A1 | | 10/2001 |
| YU | P 1756/88 | | | 6/1990 |
| YU | P 1728/88 | | | 2/1992 |

OTHER PUBLICATIONS

Hanjalic et al., "Detonation-Wave Technique for On-Load Deposit . . . ", Journal of Engineering for Gas Turbines and Power, Jan. 1994, pp. 223-236, vol. 116.

Huque, "Experimental Investigation of Slag Removal Using . . . ", Annual Symposium, Mar. 16-18, 1999, pp. 1-6, Miami, FL.

Hanjalic et al., "Further Experience in Using Detonation Waves . . . ", International Journal of Energy Research, Apr. 7, 1993, pp. 583-595, vol. 17.

* cited by examiner

CONTROL OF DETONATIVE CLEANING APPARATUS

FIELD OF THE INVENTION

The invention relates to industrial equipment. More particularly, the invention relates to the detonative cleaning of industrial equipment.

DESCRIPTION OF THE RELATED ART

Surface fouling is a major problem in industrial equipment. Such equipment includes furnaces (coal, oil, waste, etc.), boilers, gasifiers, reactors, heat exchangers, and the like. Typically the equipment involves a vessel containing internal heat transfer surfaces that are subjected to fouling by accumulating particulate such as soot, ash, and minerals, more integrated buildup such as slag and/or fouling, and the like. Such particulate build-up may progressively interfere with plant operation, reducing efficiency and throughput and potentially causing damage. Cleaning of the equipment is therefore highly desirable and is attended by a number of relevant considerations. Often direct access to the fouled surfaces is difficult. Additionally, to maintain revenue it is desirable to minimize downtime associated with cleaning. A variety of technologies have been proposed. By way of example, various technologies have been proposed in U.S. Pat. Nos. 5,494,004 and 6,438,191 and U.S. patent application publication 2002/0112638. Additional technology is disclosed in Huque, Z. Experimental Investigation of Slag Removal Using Pulse Detonation Wave Technique, DOE/HBCU/OMI Annual Symposium, Miami, Fla., Mar. 16-18, 1999. Particular blast wave techniques are described by Hanjalić and Smajević in their publications: Hanjalić, K. and Smajević, I., Further Experience Using Detonation Waves for Cleaning Boiler Heating Surfaces, International Journal of Energy Research Vol. 17, 583-595 (1993) and Hanjalić, K. and Smajević, I., Detonation-Wave Technique for On-load Deposit Removal from Surfaces Exposed to Fouling: Parts I and II, Journal of Engineering for Gas Turbines and Power, Transactions of the ASME, Vol. 1, 116 223-236, January 1994. Such systems are also discussed in Yugoslav patent publications P 1756/88 and P 1728/88. Such systems are often identified as "soot blowers" after the key application for the technology.

Nevertheless, there remain opportunities for further improvement in the field.

SUMMARY OF THE INVENTION

One aspect of the invention involves an apparatus for cleaning one or more surfaces within a vessel having a vessel wall separating a vessel exterior from a vessel interior and having a wall aperture. An elongate conduit has an upstream first end and a downstream second end and is positioned to direct a shockwave from the second end into the vessel interior. A source of fuel and oxidizer is coupled to the conduit to deliver the fuel and oxidizer to the conduit. An initiator is positioned to initiate a reaction of the fuel and oxidizer to produce the shockwave. A sensor senses one or more thermodynamic properties associated with the vessel. A control system is coupled to the initiator, the source, and the sensor.

In various implementations, there may be a number of such sensors including at least one temperature sensor and at least one pressure sensor. Such sensors may include at least one thermocouple positioned on the conduit or on the vessel and at least one infrared sensor. The at least one infrared sensor may include an infrared camera. The sensors may include at least one combustion emission sensor. There may be a number of such conduits and such initiators, each of the conduits associated with an associated one or more of the initiators. The control system may include a plurality of local controllers respectively associated with and so coupled to an associated one of the initiators. The control system may further include a central controller coupled to the plurality of local controllers. The central controller may be programmed to generate maintenance or service requests responsive to the input. The control system may be programmed to communicate with a remote monitoring system. The control system may be programmed to control operation of the conduit responsive to input from the sensor. The control system may be programmed with a number of different cleaning processes or protocols to execute the processes responsive to corresponding sensed conditions. An imaging inspection camera may be coupled to the control system for visual monitoring of the vessel interior.

Another aspect of the invention involves a monitoring system for monitoring the operation of a number of remote detonative cleaning apparatus. A communications interface communicates with the apparatus. At least one of memory and a processor stores instructions for receiving data from the apparatus and recording information regarding the apparatus.

In various implementations, at least one of the processor and memory may store instructions for causing the apparatus to operate. The monitoring system may include one or more displays. At least one of the one or more displays may be connected to permit at least part time display of a video camera input. The system may be used in combination with a number of such apparatus. The apparatus may comprise a number of cleaning systems. Each cleaning system may comprise a number of combustion conduits and a number of local control modules, each associated with a given single one of the combustion conduits. The cleaning systems may further include a fuel and oxidizer source coupled to the combustion conduits and a common control system coupled to the local control modules and configured to provide the data to the monitoring system.

Another aspect of the invention involves a method for cleaning surfaces within a number of vessels at a number of locations. At a central location, data is monitored regarding each of the vessels. Responsive to the monitored data for a particular one of the vessels, a detonative cleaning apparatus associated with a particular vessel is caused to be discharged to clean the surface within the particular vessel.

In various implementations, the method may be performed via a programmed control and monitoring system that is programmed to select, responsive to the monitored data, at least one of a number of at least partially predetermined cleaning protocols and to cause the discharge according to the selected protocol. The method may be performed in a repeated sequential way. An infrared camera may be used within each vessel to inspect the associated surface while the vessel is in operation. The monitoring may include at least one of monitoring a surface emissivity within the vessel, monitoring an image of a vessel interior, and monitoring a quantity of a chemical species in the vessel interior. The method may include receiving an automated maintenance or service request for at least one of the vessels. The request may be specific to one of the apparatus or may be general.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
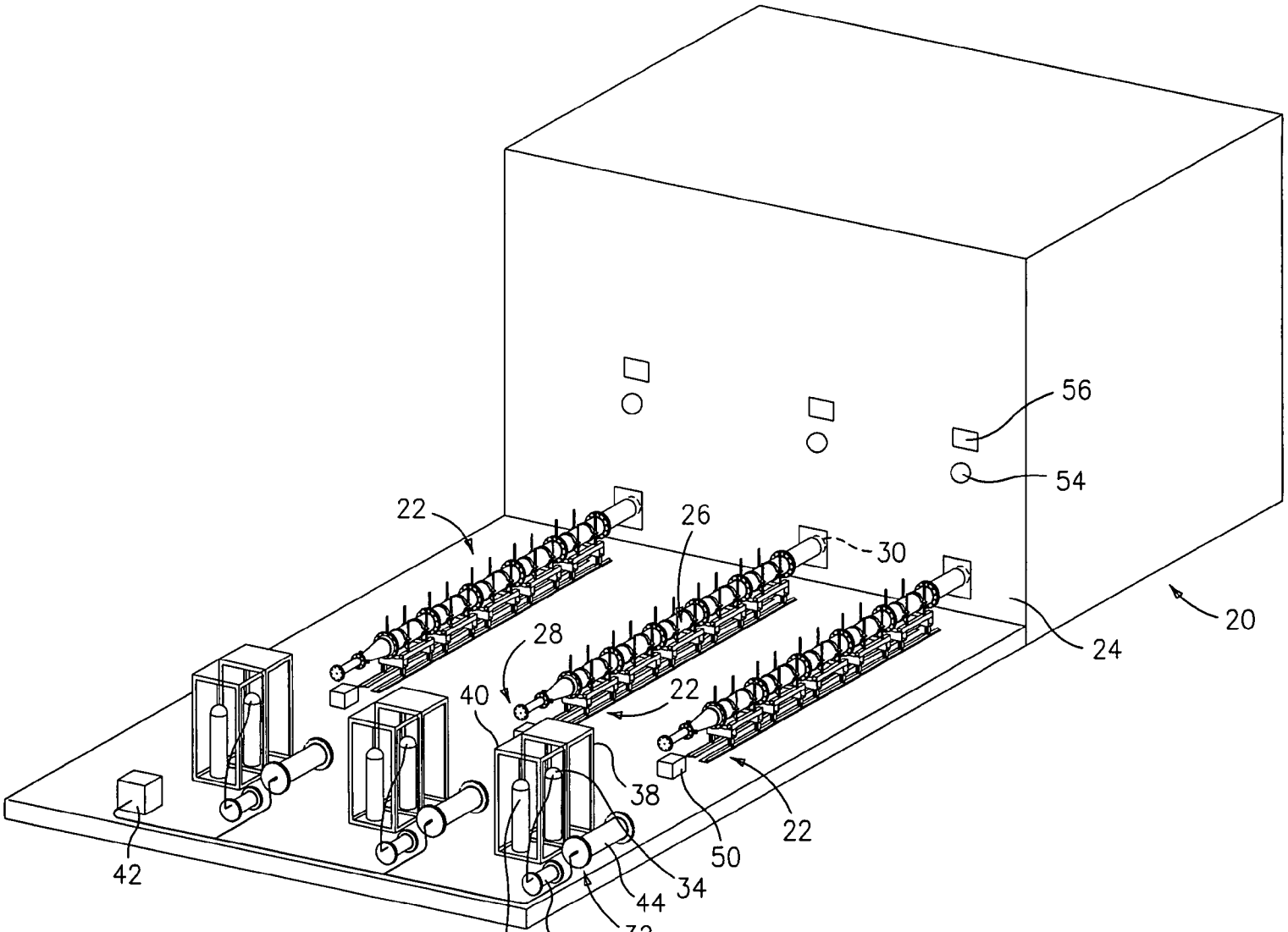
FIG. 1 is a view of an industrial furnace associated with several soot blowers positioned to clean a level of the furnace.

FIG. 1 shows a furnace 20 having an exemplary three associated soot blowers 22. In the illustrated embodiment, the furnace vessel is formed as a right parallelepiped and the soot blowers are all associated with a single common wall 24 of the vessel and are positioned at like height along the wall. Other configurations are possible (e.g., a single soot blower, one or more soot blowers on each of multiple levels, and the like).

Each soot blower 22 includes an elongate combustion conduit 26 extending from an upstream distal end 28 away from the furnace wall 24 to a downstream proximal end 30 closely associated with the wall 24. Optionally, however, the end 30 may be well within the furnace. In operation of each soot blower, combustion of a fuel/oxidizer mixture within the conduit 26 is initiated proximate the upstream end (e.g., within an upstreammost 10% of a conduit length) to produce a detonation wave which is expelled from the downstream end as a shockwave along with associated combustion gases for cleaning surfaces within the interior volume of the furnace. Each soot blower may be associated with a fuel/oxidizer source 32. Such source or one or more components thereof may be shared amongst the various soot blowers. An exemplary source includes a liquefied or compressed gaseous fuel cylinder 34 and an oxygen cylinder 36 in respective containment structures 38 and 40. In the exemplary embodiment, the oxidizer is a first oxidizer such as essentially pure oxygen. A second oxidizer may be in the form of shop air delivered from a central air source 42. In the exemplary embodiment, air is stored in an air accumulator 44. Fuel, expanded from that in the cylinder 34 is generally stored in a fuel accumulator 46. Each exemplary source 32 is coupled to the associated conduit 26 by appropriate plumbing below. Similarly, each soot blower includes a spark box 50 for initiating combustion of the fuel oxidizer mixture and which, along with the source 32, is controlled by a control and monitoring system (not shown). FIG. 1 further shows the wall 24 as including a number of ports for inspection and/or measurement. Exemplary ports include an optical monitoring port 54 and a temperature monitoring port 56 associated with each soot blower 22 for respectively receiving an infrared and/or visible light video camera and thermocouple probe for viewing the surfaces to be cleaned and monitoring internal temperatures. Other probes/monitoring/sampling may be utilized, including pressure monitoring, composition sampling, and the like.

Figure 2:
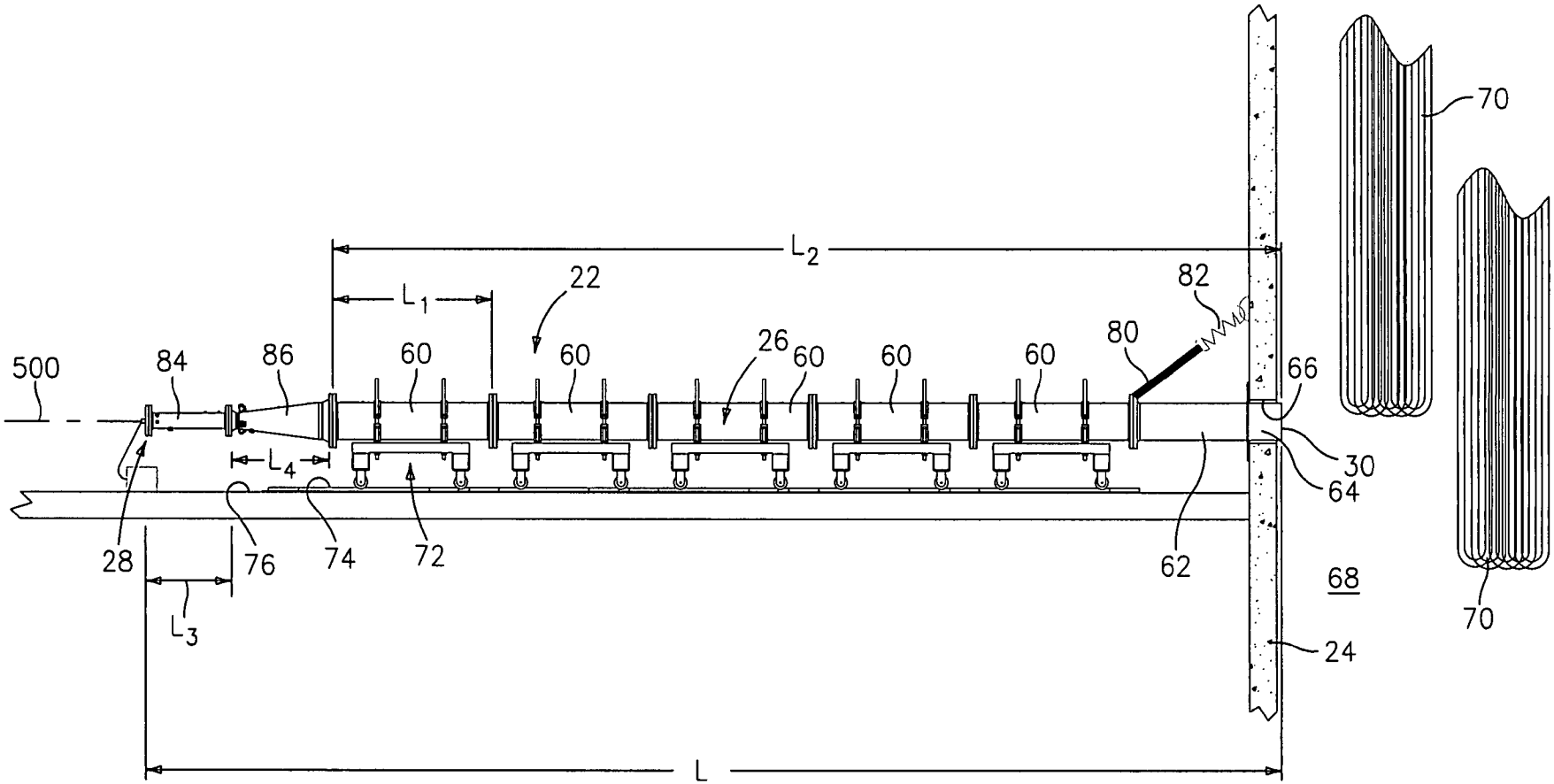
FIG. 2 is a side view of one of the blowers of FIG. 1.

FIG. 2 shows further details of an exemplary soot blower 22. The exemplary detonation conduit 26 is formed with a main body portion formed by a series of doubly flanged conduit sections or segments 60 arrayed from upstream to downstream and a downstream nozzle conduit section or segment 62 having a downstream portion 64 extending through an aperture 66 in the wall and ending in the downstream end or outlet 30 exposed to the furnace interior 68. The term nozzle is used broadly and does not require the presence of any aerodynamic contraction, expansion, or combination thereof. Exemplary conduit segment material is metallic (e.g., stainless steel). The outlet 30 may be located further within the furnace if appropriate support and cooling are provided. FIG. 2 further shows furnace interior tube bundles 70, the exterior surfaces of which are subject to fouling. In the exemplary embodiment, each of the conduit segments 60 is supported on an associated trolley 72, the wheels of which engage a track system 74 along the facility floor 76. The exemplary track system includes a pair of parallel rails engaging concave peripheral surfaces of the trolley wheels. The exemplary segments 60 are of similar length $L_1$ and are bolted end-to-end by associated arrays of bolts in the bolt holes of their respective flanges. Similarly, the downstream flange of the downstreammost of the segments 60 is bolted to the upstream flange of the nozzle 62. In the exemplary embodiment, a reaction strap 80 (e.g., cotton or thermally/structurally robust synthetic) in series with one or more metal coil reaction springs 82 is coupled to this last mated flange pair and connects the combustion conduit to an environmental structure such as the furnace wall for resiliently absorbing reaction forces associated with discharging of the soot blower and ensuring correct placement of the combustion conduit for subsequent firings. Optionally, additional damping (not shown) may be provided. The reaction strap/spring combination may be formed as a single length or a loop. In the exemplary embodiment, this combined downstream section has an overall length $L_2$. Alternative resilient recoil absorbing means may include non-metal or non-coil springs or rubber or other elastomeric elements advantageously at least partially elastically deformed in tension, compression, and/or shear, pneumatic recoil absorbers, and the like.

Extending downstream from the upstream end 28 is a predetonator conduit section/segment 84 which also may be doubly flanged and has a length $L_3$. The predetonator conduit segment 84 has a characteristic internal cross-sectional area (transverse to an axis/centerline 500 of the conduit) which is smaller than a characteristic internal cross-sectional area (e.g., mean, median, mode, or the like) of the downstream portion (60, 62) of the combustion conduit. In an exemplary embodiment involving circular sectioned conduit segments, the predetonator cross-sectional area is a characterized by a diameter of between 8 cm and 12 cm whereas the downstream portion is characterized by a diameter of between 20 cm and 40 cm. Accordingly, exemplary cross-sectional area ratios of the downstream portion to the predetonator segment are between 1:1 and 10:1, more narrowly, 2:1 and 10:1. An overall length L between ends 28 and 30 may be 1-15 m, more narrowly, 5-15 m. In the exemplary embodiment, a transition conduit segment 86 extends between the predetonator segment 84 and the upstreammost segment 60. The segment 86 has upstream and downstream flanges sized to mate with the respective flanges of the segments 84 and 60 has an interior surface which provides a smooth transition between the internal cross-sections thereof. The exemplary segment 86 has a length $L_4$. An exemplary half angle of divergence of the interior surface of segment 86 is $\leqq 12°$, more narrowly 5-10°.

Figure 3:
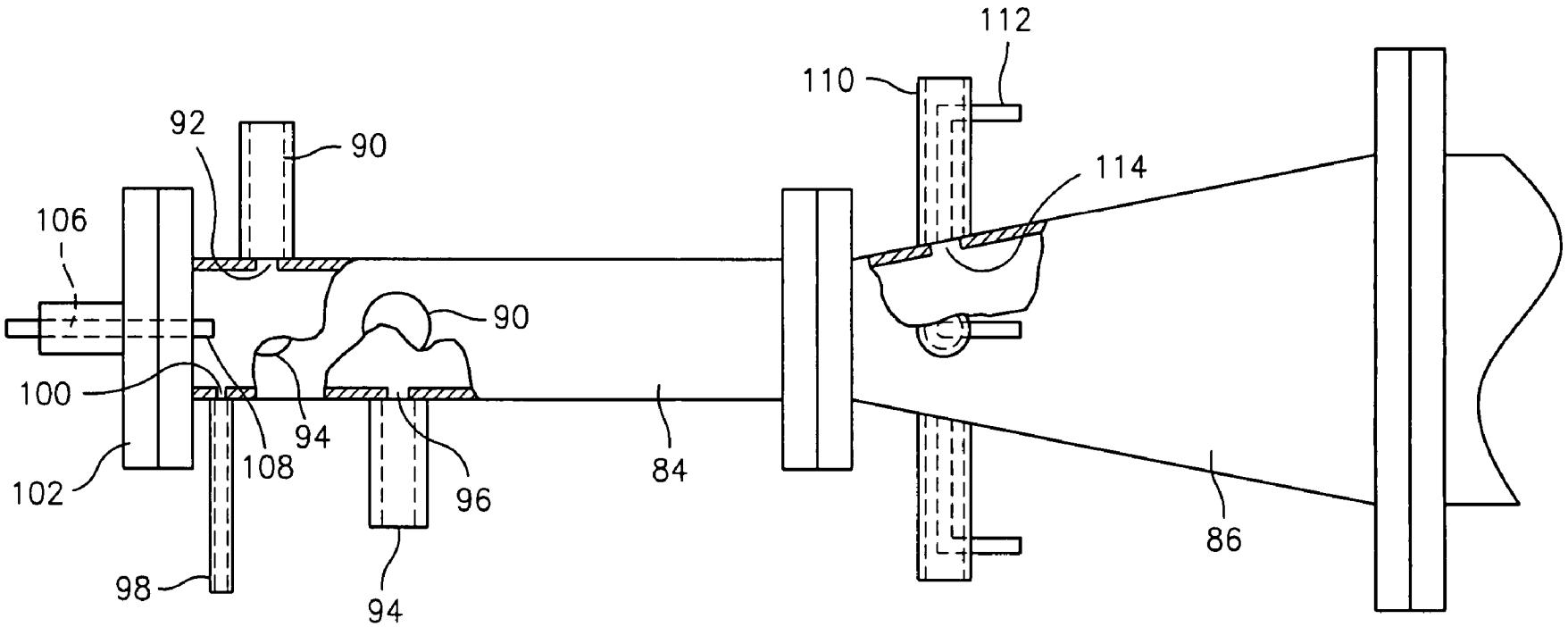
FIG. 3 is a partially cut-away side view of an upstream end of the blower of FIG. 2.

A fuel/oxidizer charge may be introduced to the detonation conduit interior in a variety of ways. There may be one or more distinct fuel/oxidizer mixtures. Such mixture(s) may be premixed external to the detonation conduit, or may be mixed at or subsequent to introduction to the conduit. FIG. 3 shows the segments 84 and 86 configured for distinct introduction of two distinct fuel/oxidizer combinations: a predetonator combination; and a main combination. In the exemplary embodiment, in an upstream portion of the segment 84, a pair of predetonator fuel injection conduits 90 are coupled to ports 92 in the segment wall which define fuel injection ports. Similarly, a pair of predetonator oxidizer conduits 94 are coupled to oxidizer inlet ports 96. In the exemplary embodiment, these ports are in the upstream half of the length of the segment 84. In the exemplary embodiment, each of the fuel injection ports 92 is paired with an associated one of the oxidizer ports 96 at even axial position and at an angle (exemplary 90° shown, although other angles including 180° are possible) to provide opposed jet mixing of fuel and oxidizer. Discussed further below, a purge gas conduit 98 is similarly connected to a purge gas port 100 yet further upstream. An end plate 102 bolted to the upstream flange of the segment 84 seals the upstream end of the combustion conduit and passes through an igniter/initiator 106 (e.g., a spark plug) having an operative end 108 in the interior of the segment 84.

In the exemplary embodiment, the main fuel and oxidizer are introduced to the segment 86. In the illustrated embodiment, main fuel is carried by a number of main fuel conduits 112 and main oxidizer is carried by a number of main oxidizer conduits 110, each of which has terminal portions concentrically surrounding an associated one of the fuel conduits 112 so as to mix the main fuel and oxidizer at an associated inlet 114. In exemplary embodiments, the fuels are hydrocarbons. In particular exemplary embodiments, both fuels are the same, drawn from a single fuel source but mixed with distinct oxidizers: essentially pure oxygen for the predetonator mixture; and air for the main mixture. Exemplary fuels useful in such a situation are propane, MAPP gas, or mixtures thereof. Other fuels are possible, including ethylene and liquid fuels (e.g., diesel, kerosene, and jet aviation fuels). The oxidizers can include mixtures such as air/oxygen mixtures of appropriate ratios to achieve desired main and/or predetonator charge chemistries. Further, monopropellant fuels having molecularly combined fuel and oxidizer components may be options.

In operation, at the beginning of a use cycle, the combustion conduit is initially empty except for the presence of air (or other purge gas). The predetonator fuel and oxidizer are then introduced through the associated ports filling the segment 84 and extending partially into the segment 86 (e.g., to near the midpoint) and advantageously just beyond the main fuel/oxidizer ports. The predetonator fuel and oxidizer flows are then shut off. An exemplary volume filled the predetonator fuel and oxidizer is 1-40%, more narrowly 1-20%, of the combustion conduit volume. The main fuel and oxidizer are then introduced, to substantially fill some fraction (e.g., 20-100%) of the remaining volume of the combustor conduit. The main fuel and oxidizer flows are then shut off. The prior introduction of predetonator fuel and oxidizer past the main fuel/oxidizer ports largely eliminates the risk of the formation of an air or other non-combustible slug between the predetonator and main charges. Such a slug could prevent migration of the combustion front between the two charges.

With the charges introduced, the spark box is triggered to provide a spark discharge of the initiator igniting the predetonator charge. The predetonator charge being selected for very fast combustion chemistry, the initial deflagration quickly transitions to a detonation within the segment 84 and producing a detonation wave. Once such a detonation wave occurs, it is effective to pass through the main charge which might, otherwise, have sufficiently slow chemistry to not detonate within the conduit of its own accord. The wave passes longitudinally downstream and emerges from the downstream end 30 as a shockwave within the furnace interior, impinging upon the surfaces to be cleaned and thermally and mechanically shocking to typically at least loosen the contamination. The wave will be followed by the expulsion of pressurized combustion products from the detonation conduit, the expelled products emerging as a jet from the downstream end 30 and further completing the cleaning process (e.g., removing the loosened material). After or overlapping such venting of combustion products, a purge gas (e.g., air from the same source providing the main oxidizer and/or nitrogen) is introduced through the purge port 100 to drive the final combustion products out and leave the detonation conduit filled with purge gas ready to repeat the cycle (either immediately or at a subsequent regular interval or at a subsequent irregular interval (which may be manually or automatically determined by the control and monitoring system)). Optionally, a baseline flow of the purge gas may be maintained between charge/discharge cycles so as to prevent gas and particulate from the furnace interior from infiltrating upstream and to assist in cooling of the detonation conduit.

Figure 4:
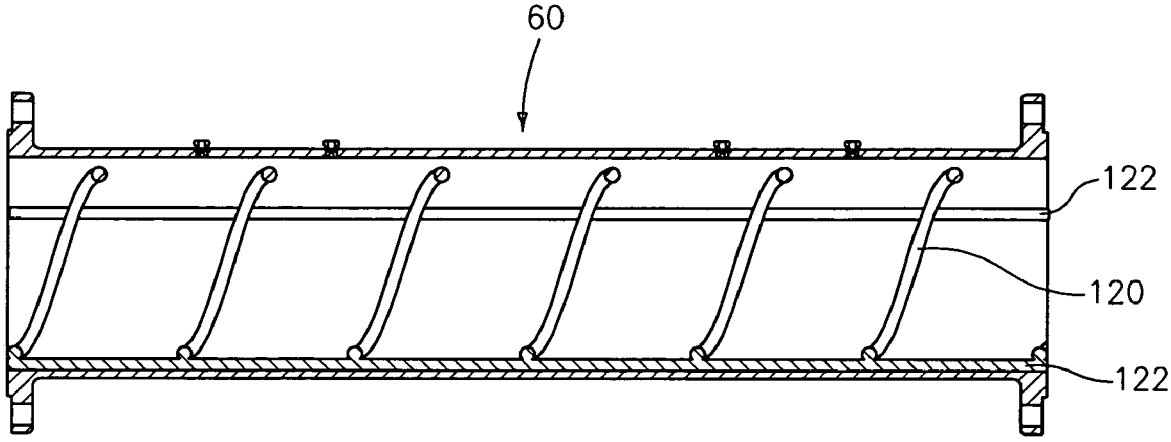
FIG. 4 is a longitudinal sectional view of a main combustor segment of the soot blower of FIG. 2.
Figure 5:
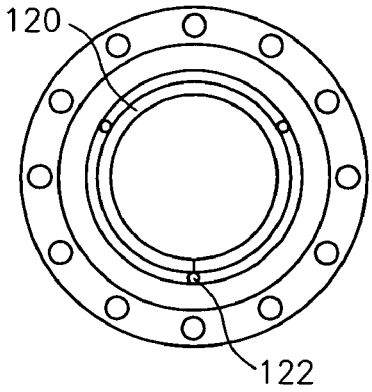
FIG. 5 is an end view of the segment of FIG. 4.

In various implementations, internal surface enhancements may substantially increase internal surface area beyond that provided by the nominally cylindrical and frustoconical segment interior surfaces. The enhancement may be effective to assist in the deflagration-to-detonation transition or in the maintenance of the detonation wave. FIG. 4 shows internal surface enhancements applied to the interior of one of the main segments 60. The exemplary enhancement is nominally a Chin spiral, although other enhancements such as Shchelkin spirals and Smirnov cavities may be utilized. The spiral is formed by a helical member 120. The exemplary member 120 is formed as a circular-sectioned metallic element (e.g., stainless steel wire) of approximately 8-20 mm in sectional diameter. Other sections may alternatively be used. The exemplary member 120 is held spaced-apart from the segment interior surface by a plurality of longitudinal elements 122. The exemplary longitudinal elements are rods of similar section and material to the member 120 and welded thereto and to the interior surface of the associated segment 60. Such enhancements may also be utilized to provide predetonation in lieu of or in addition to the foregoing techniques involving different charges and different combustor cross-sections.

The apparatus may be used in a wide variety of applications. By way of example, just within a typical coal-fired furnace, the apparatus may be applied to: the pendants or secondary superheaters, the convective pass (primary superheaters and the economizer bundles); air preheaters; selective catalyst removers (SCR) scrubbers; the baghouse or electrostatic precipitator; economizer hoppers; ash or other heat/accumulations whether on heat transfer surfaces or elsewhere, and the like. Similar possibilities exist within other applications including oil-fired furnaces, black liquor recovery boilers, biomass boilers, waste reclamation burners (trash burners), and the like.

Figure 6:
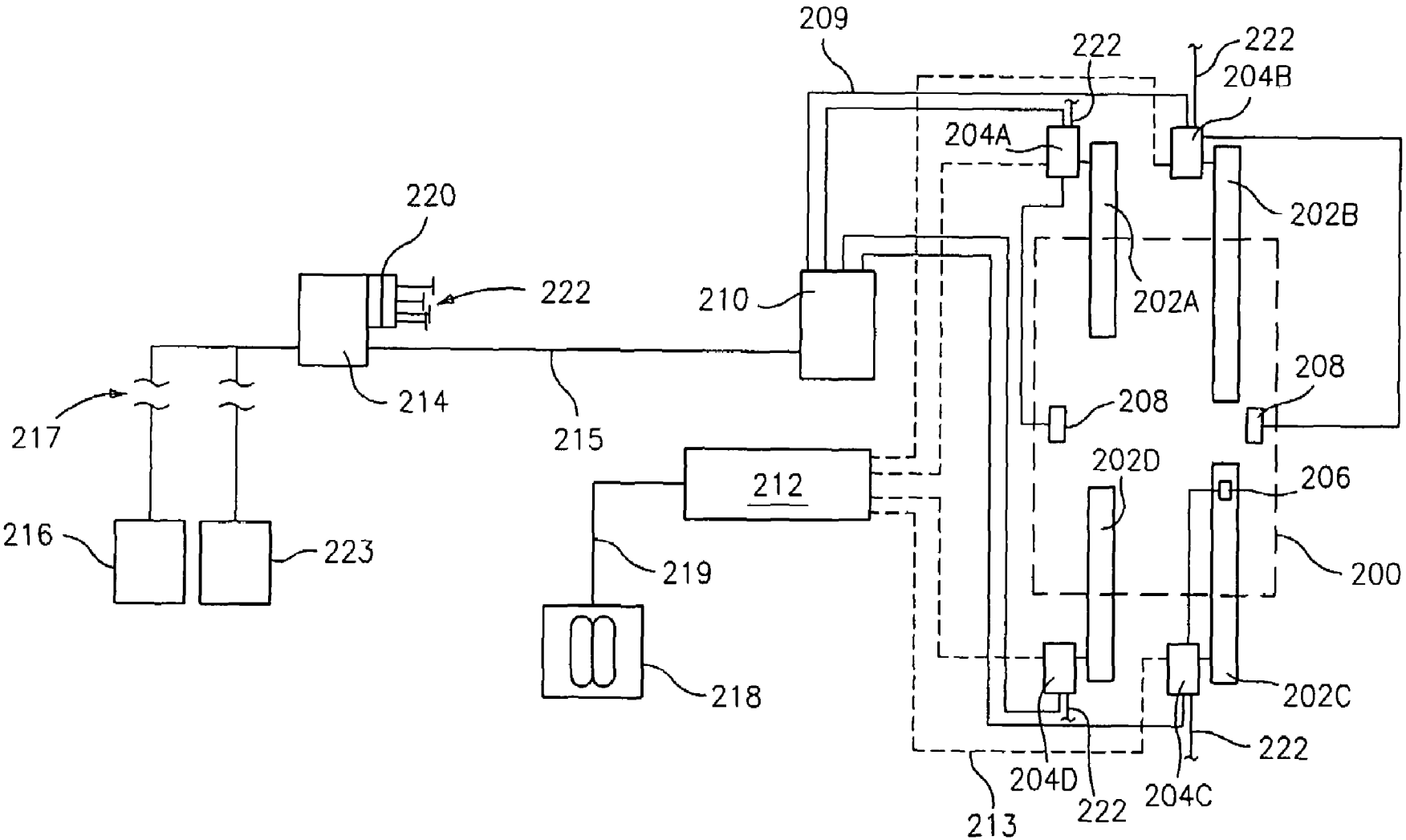
FIG. 6 is a schematic view of a control system for multiple cleaning apparatus.

A variety of systems may be provided for monitoring and/or controlling operation of the detonative cleaning apparatus. The implementation of any particular control and monitoring system may be influenced by the physical environment including the nature and configuration of the vessel and its surfaces and the arrangement of the combustion conduit(s). FIG. 6 schematically shows one of a number of levels of a vessel 200. At this level, a number of combustion conduits 202A-D are positioned. In the exemplary embodiment, downstream outlets of the conduits are positioned in the interior of the vessel and upstream ends are external to the vessel. Although shown straight, the conduits may have non-straight configurations to discharge shockwaves in desired locations with desired directions. Each conduit is closely associated with an interface module 204A-D which may provide local control of various operational parameters (e.g., including fuel and oxidizer introduction, purge and cooling gas introduction, initiation, and the like). Further details of an exemplary interface module are discussed below. The given vessel level may also include sensors 206 and 208. However, the sensors need not be level-specific. Similarly, the conduits could be other than level-specific and other than oriented to discharge in parallel planes. The sensors may be conduit-specific (e.g., close to the outlet of a specific associated conduit or to the furnace surface cleaned by such conduit) or may be more generally located. The sensors may detect one or more of thermal conditions, pressures, flows, chemical conditions, and/or visual conditions. Exemplary sensor operation is discussed in further detail below.

For signal communication, the modules and sensors are coupled via communication lines 209 to a hub (e.g., ethernet) 210. In the exemplary embodiment, the sensors are coupled to the hub via the modules (e.g., coupled to the modules by communication or signal lines). For physical input (e.g., fuel, oxidizer, purge gas, coolant, power, and the like), the modules are coupled to a central supply unit 212 via fluid and power lines 213. The hub and supply unit may be level-specific, common, or some combination. The hub is coupled for signal communication (e.g., via network lines 215 such as a fiber optic line, Ethernet line, or the like) to a control and monitoring system 214 of the facility (e.g., a general purpose computer running control/monitoring software) which may be specific to the vessel or central to a group of vessels at a site (e.g., a given facility). The supply unit may similarly be coupled to the system 214 via the hub 210 or may exist independently. The system 214 is in communication with a remote control and monitoring system 216. The system 216 may be in secure communication with a number of systems 214 at a number of different sites. In such a situation, however, the system 216 may be colocated with one or more of those systems 214 and off-site of the others. The exemplary communication between the system 216 and systems 214 is via a wide area network 217 such as the internet. Alternative public and private networks or other communication systems may be used. The supply unit 212 may, itself, be fed from a remotely located tank farm 218 (e.g., a central tank farm of the facility) via lines 219 for supply of non-air gases and other fluids and from appropriate shop air and power sources (not shown) which may also be central sources of the facility). The system 214 may communicate with several central systems. For example, the system 216 may be a central system of a facility owner/operator communicating with systems 214 at various facilities of that owner/operator. A central system 223 may be a central system of a service vendor communicating with systems 214 of various facilities of various owners/operators either directly or via the systems 216. Based ultimately upon data provided by the sensors 206 and 208, the systems 214 may inform the system 223 that service or routine maintenance is necessary or otherwise appropriate (the decision being made at any of the systems 214, 216, or 223).

In the exemplary embodiment, an emergency control panel 220 is in close proximity to the system 214. The exemplary emergency control panel includes one or more status lights and one or more switches (e.g., red/green status lights and emergency kill switches for each conduit plus a master kill switch for all conduits). These are coupled by lines 222 extending to the individual interface modules. In the event of a control system failure which might prevent control (namely safing) of the conduits via the system 214 and hub 210, the kill switches may be tripped by a technician to safe the conduits (e.g., shut the fuel and oxidizer valves, disable the ignition, and the like, to safely shut down and/or disable the associated conduits). The interface modules themselves may be set up in a failsafe mode whereby a break in the associated line(s) 215 or 222 causes a module to transition to a safe mode.

Figure 7:
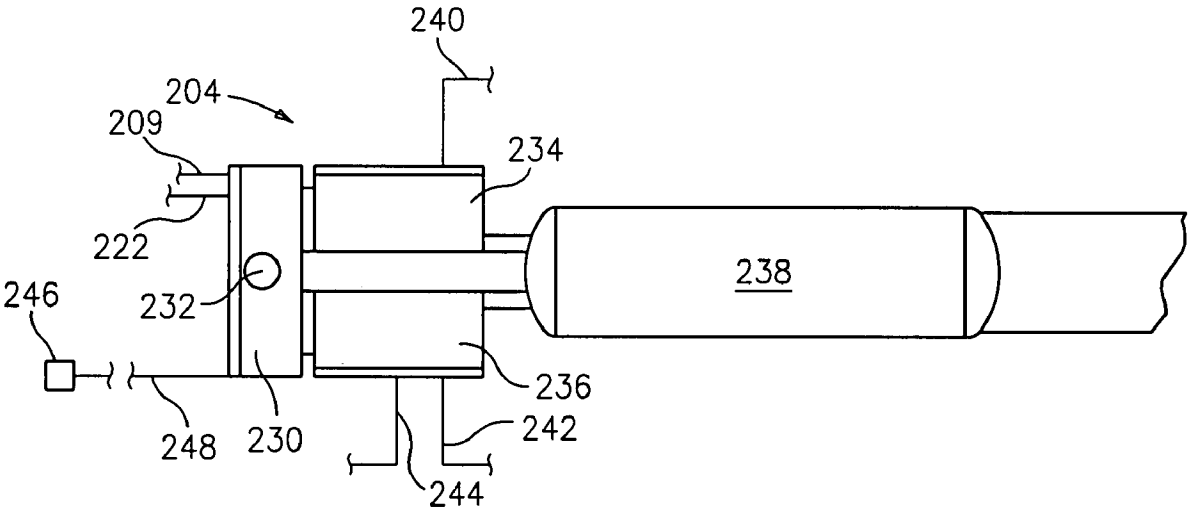
FIG. 7 is a top view of an exemplary interface module of the apparatus of FIG. 6.
Figure 8:
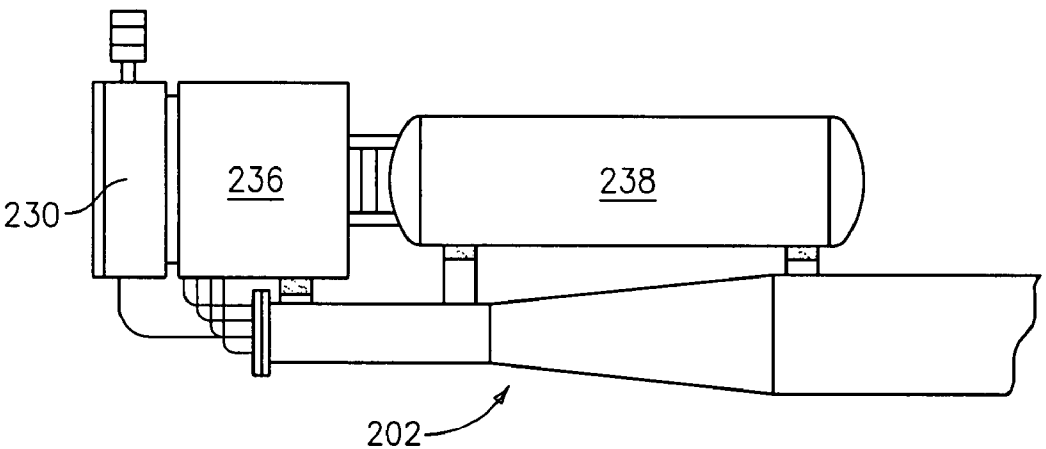
FIG. 8 is a side view of the interface module of FIG. 7.

FIGS. 7 and 8 show an exemplary interface module 204 in association with a combustion conduit 202. In the exemplary implementation, the interface module includes a control electronics enclosure 230 from which a status light 232 extends. In close proximity to the enclosure 230 are respective fuel and oxidizer valve enclosures 234 and 236 and an air accumulator 238. In the exemplary embodiment, fuel and oxidizer lines 240 and 242 extend into the valve enclosures 234 and 236 and connect with electronically-controlled valves (not shown) which, in turn, are connected via appropriate fluid lines to the conduit 202. Similarly, a shop air line 244 may connect to the oxidizer valve enclosure 236. The control enclosure is connected via appropriate ones of the lines 209 to both the control panel 220 and to the hub 210. A local kill switch 246 may be connected to the control electronics via a line 248 and may be mounted directly on the electronics enclosure 230 or in proximity thereto.

Figure 9:
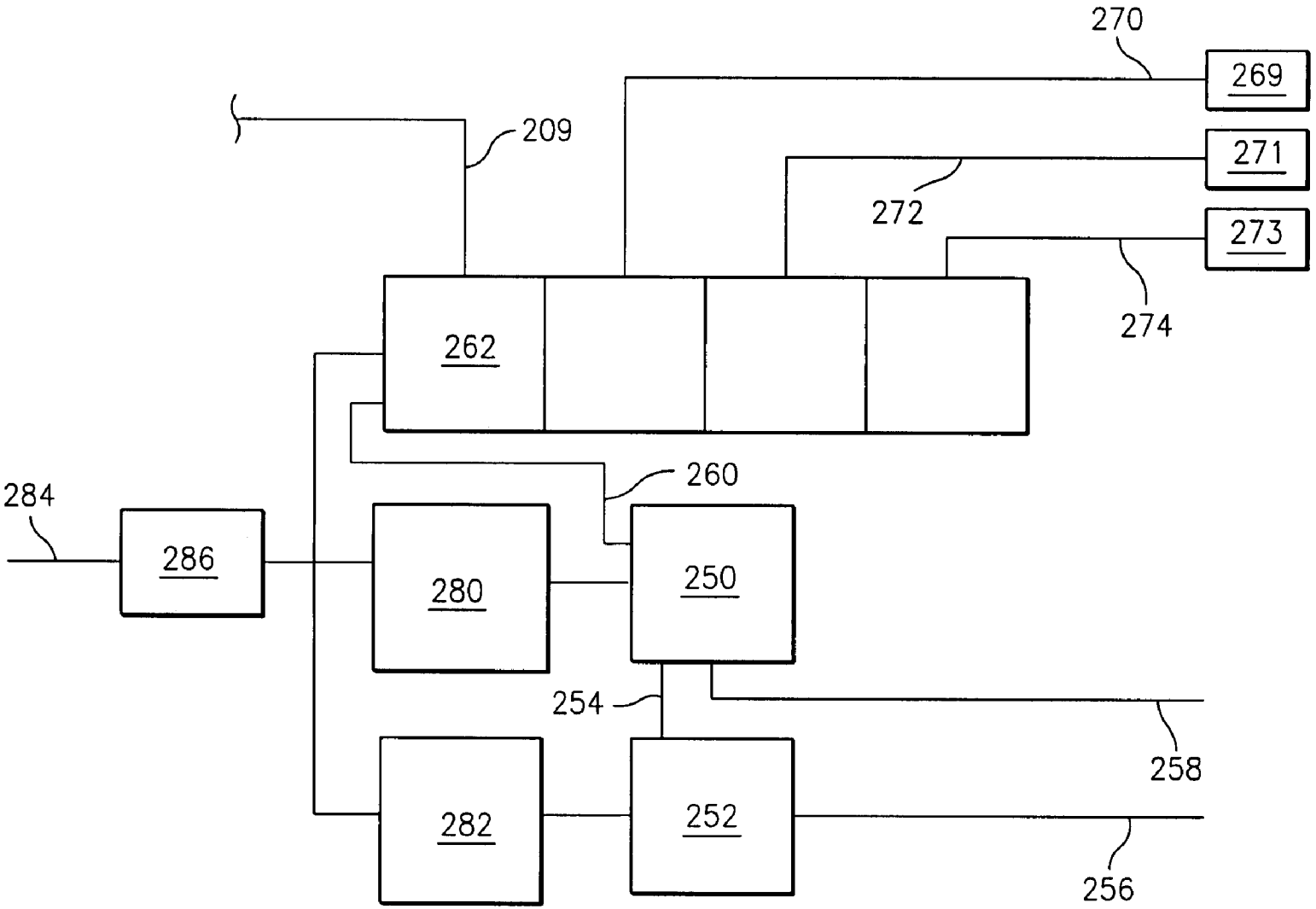
FIG. 9 is a schematic view of control electronics for the interface module of FIG. 7.

FIG. 9 shows exemplary control electronics from the electronics enclosure 230 of the interface module 204. The electronics serve as a local control/monitoring system specific to the associated conduit. The core of the electronics is a CPU emulator board 250 running interface control software. The emulator 250 communicates with a relay bank 252 via lines 254 for controlling the various valves within the enclosures 234 and 236 associated with the respective relays via valve control lines 256. For safety, advantageously the valves are fail-closed. To ensure successful detonation wave creation, the emulator 250 receives a timer input via a line 258 connected to conduit-mounted ionization probes (e.g., two probes longitudinally spaced near the conduit downstream end and representing subsets of the generically-identified sensors 206). The emulator communicates via lines 260 with an ethernet based controller 262 that interfaces with the hub 212 via the lines 209. The controller 262 is configured to receive input from thermocouples and resistance temperature detectors (RTD) via lines 270, from pressure sensors via analog lines 272, and limit switches via discrete input lines 274. In an exemplary implementation, the thermocouples may be connected at various locations along the conduit, to the valve enclosures, or somewhere within the vessel. The pressure sensors (e.g., transducers) may measure pressures in one or more locations in the valve enclosures or other locations. The thermocouples/RTDs may represent subsets of the generically-identified sensors 206 and 208. Additional pressure sensors may take the form of probes such as those disclosed in commonly-owned copending application docket EH-10968 (03-438), entitled "PRESSURE PROBE", the disclosure of which is incorporated herein by reference as if set forth at length. The limit switches may verify the positioning of mechanical hardware (e.g., to confirm that enclosures are securely closed before firing).

Power for the emulator and solenoid bank is supplied by DC power supplies 280 and 282 drawing power from an AC power source 284. In the exemplary embodiment, an uninterruptible power supply (UPS)/battery back-up 286 delivers the AC power to the power supplies 280 and 282 and the ethernet controller in the event of loss of power from the source 284.

In operation, a variety of means may permit the control and monitoring system 214 to decide to initiate detonative cleaning by one or more of the conduits and to determine characteristics of such cleaning. The identified sensors may include combinations of imaging or non-imaging radiation sensors (e.g., IR sensors). An exemplary imaging sensor (a camera) is disclosed in copending application docket EH-10969 (03-439), entitled "INSPECTION CAMERA", the disclosure of which is incorporated by reference herein as if set forth at length. Alternatively, or additionally, sensors external to the vessel may monitor the vessel interior through windows as described above. The sensors may provide an indication of chemical emissions (e.g., pollutants). For example, ions such as $CH^-$ and $OH^-$ have characteristic frequencies which can be sensed (e.g., 324 nm and 282 nm in the IR band). Emissivity or other measurements may directly detect build-up on surfaces. Temperature measurements of fluid traveling through tube bundles may provide indications of insulative build-up on the tubes. The sensors may facilitate continuous monitoring.

In operation, the various sensors may be used to determine the nature of any build-up (e.g., the composition of a deposit, the thickness of the deposit, and the extent of the deposit). These may be used to determine appropriate cleaning sequences/protocols characterized by the particular conduits to be discharged and the characteristics of such discharge (e.g., the nature and quantity of the particular fuel/oxidizer charge(s) to be introduced to particular conduit(s)). The relative timing of the firing of different conduits may be selected to achieve desired performance (this may include delays to avoid interference or synchronization to provide a combined effect). After a firing sequence (which may include one or more firings of one or more conduits) there may be a reassessment to determine whether further firings are appropriate based on sensor input. The results of such reassessment and subsequent reassessments may be used to fine tune particular cleaning protocols for future use. Data from the sensors may also be used to determine the condition of the cleaning system and its components. A lack of input from ion sensors may indicate a lack of detonations. Pressure sensors may indicate insufficient or excess fuel or oxidizer pressures. Temperature sensors may indicate conduit overheating. Such abnormal condition data may cause a warning to be displayed and may cause n automated service/maintenance request to be generated. In an exemplary implementation, the control system 214 may be programmed to generally command any of various kinds of single shot discharges and send corresponding commands to the control electronics of the individual conduits. That control electronics may store the information necessary to actually charge and discharge in the appropriate way for the specific shot (e.g., the fuel/oxidizer amounts). For example, the control system 214 may send a general command representative of a sharp, high power pulse to the local control electronics which, in turn, is able to generate the shot even though the fill parameters for a sharp, high power shot may differ amongst the conduits. The control system 214 may further be programmed to generate combinations of such shots for particular protocols.

One or more embodiments of the present invention have been described. Nevertheless, it will be understood that various modifications may be made without departing from the spirit and scope of the invention. For example, the invention may be adapted for use with a variety of industrial equipment and with variety of soot blower technologies. Aspects of the existing equipment and technologies may influence aspects of any particular implementation. Accordingly, other embodiments are within the scope of the following claims.

What is claimed is:

1. An apparatus for cleaning one or more surfaces within a vessel having a vessel wall separating a vessel exterior from a vessel interior and having a wall aperture, the apparatus comprising:

at least one elongate conduit having an upstream first end and a downstream second end and positioned to direct a shockwave from the second end into the vessel interior; and a source of fuel and oxidizer coupled to the conduit to deliver the fuel and oxidizer to the conduit;

an initiator positioned to initiate a reaction of the fuel and oxidizer to produce the shockwave;

at least one sensor for sensing one or more thermodynamic properties associated with the vessel and including means for ion sensing; and a control system coupled to the initiator, the source, and the sensor for receiving input from the sensor and controlling operation of the initiator and source responsive to said input.

2. The apparatus of claim 1 wherein:

there are a plurality of such sensors including at least one temperature sensor and at least one pressure sensor.

3. The apparatus of claim 1 wherein:

there are a plurality of such sensors including at least one thermocouple positioned on the conduit or on the vessel and at least one infrared sensor.

4. The apparatus of claim 3 wherein:

the at least one infrared sensor includes an infrared camera.

5. The apparatus of claim 1 wherein:

there are a plurality of such sensors including at least one combustion emission sensor.

6. The apparatus of claim 1 wherein:

there are plurality of such conduits and such initiators, each of the conduits associated with an associated one or more of the initiators; and the control system includes:

a plurality of local controllers respectively associated with and so coupled to an associated one of the initiators; and a central controller coupled to the plurality of local controllers.

7. The apparatus of claim 6 wherein:

the central controller is programmed to generate maintenance or service requests responsive to the input.

8. The apparatus of claim 1 wherein:

the control system communicates with a remote monitoring system.

9. The apparatus of claim 1 wherein:

the control system is programmed to control operation of the conduit responsive to input from the sensor.

10. The apparatus of claim 1 wherein:

the control system is programmed with a plurality of different cleaning processes and to execute the processes responsive to corresponding sensed conditions.

11. The apparatus of claim 1 further comprising:

an imaging inspection camera coupled to the control system for visual monitoring of the vessel interior.

12. The apparatus of claim 1 wherein:

the control system and sensor combination is configured to detect one or more chemical species.

13. The apparatus of claim 1 wherein:

the means includes at least one conduit-mounted ionization probe.

14. The apparatus of claim 13 wherein:

the control system and at least one conduit-mounted ionization probe are configured to verify detonation.

15. The apparatus of claim 13 wherein:

the at least one conduit-mounted ionization probe comprises two probes longitudinally spaced apart.

16. The apparatus of claim 1 wherein:

the control system and sensor combination is configured to determine a condition of the apparatus.

17. The apparatus of claim 1 wherein:

the control system and sensor combination is configured to verify detonation.

18. The apparatus of claim 1 wherein:

the control system and sensor combination is configured provide an indication of chemical emissions.

19. An apparatus for cleaning one or more surfaces within a vessel having a vessel wall separating a vessel exterior from a vessel interior and having a wall aperture, the apparatus comprising:

at least one elongate conduit having an upstream first end and a downstream second end and positioned to direct a shockwave from the second end into the vessel interior; and a source of fuel and oxidizer coupled to the conduit to deliver the fuel and oxidizer to the conduit;

an initiator positioned to initiate a reaction of the fuel and oxidizer to produce the shockwave;

means for detecting one or more chemical species; and a control system coupled to the initiator, the source, and the sensor for receiving input from the sensor and controlling operation of the initiator and source responsive to said input.

20. The apparatus of claim 19 wherein:

the control system and means for detecting combination is configured provide an indication of chemical emissions including at least one of $CH^-$ and $OH^-$.

21. An apparatus for cleaning one or more surfaces within a vessel having a vessel wall separating a vessel exterior from a vessel interior and having a wall aperture, the apparatus comprising:

at least one elongate conduit having an upstream first end and a downstream second end and positioned to direct a shockwave from the second end into the vessel interior; and a source of fuel and oxidizer coupled to the conduit to deliver the fuel and oxidizer to the conduit;

an initiator positioned to initiate a reaction of the fuel and oxidizer to produce the shockwave;

a sensor detecting one or more chemical species; and a control system coupled to the initiator, the source, and the sensor for receiving input from the sensor and controlling operation of the initiator and source responsive to said input.

* * * * *

UNITED STATES PATENT AND TRADEMARK OFFICE

CERTIFICATE OF CORRECTION

PATENT NO. : 7,267,134 B2
APPLICATION NO. : 10/801215
DATED : September 11, 2007
INVENTOR(S) : James R. Hochstein, Jr.

It is certified that error appears in the above-identified patent and that said Letters Patent is hereby corrected as shown below:

In column 10, claim 6, line 58, after “there are” insert --a--.

Signed and Sealed this

Eighteenth Day of December, 2007

JON W. DUDAS
*Director of the United States Patent and Trademark Office*